US006343651B1

(12) United States Patent
Bixenman

(10) Patent No.: US 6,343,651 B1
(45) Date of Patent: Feb. 5, 2002

(54) APPARATUS AND METHOD FOR CONTROLLING FLUID FLOW WITH SAND CONTROL

(75) Inventor: Patrick W. Bixenman, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/419,585

(22) Filed: Oct. 18, 1999

(51) Int. Cl.[7] ..... E21B 39/14; E21B 43/04; E21B 43/08

(52) U.S. Cl. ..... 166/278; 166/51; 166/65.1; 166/205; 166/242.5; 166/320; 166/332.1; 166/386

(58) Field of Search ..... 166/51, 65.1, 117.5, 166/205, 227, 242.5, 278, 316, 320, 332.1, 373, 386

(56) References Cited

U.S. PATENT DOCUMENTS 5,156,220 A * 10/1992 Forehand et al. ..... 166/386
5,211,241 A * 5/1993 Mashaw, Jr. et al. ..... 166/320
5,287,930 A * 2/1994 McGill ..... 166/373
5,337,808 A 8/1994 Graham
RE34,758 E 10/1994 Farley et al.
5,377,750 A 1/1995 Arterbury et al.
5,579,844 A 12/1996 Rebardi et al.
5,641,023 A * 6/1997 Ross et al. ..... 166/386
5,842,516 A * 12/1998 Jones ..... 166/51 X
5,865,251 A 2/1999 Rebardi et al.
5,875,852 A 3/1999 Floyd et al.
5,896,928 A * 4/1999 Coon ..... 166/373

FOREIGN PATENT DOCUMENTS

FR 99/02776 5/1999

OTHER PUBLICATIONS

Baker Hughes Inc., The Equalizer Production Management System, 1999.
U.S. Patent application Ser. No. 09/243,401, filed on Feb. 1, 1999.
U.S. Patent application Ser. No. 09/346,265, filed on Jul. 1, 1999.
U.S. Patent application Ser. No. 60/155,866, filed on Sep. 24, 1999.

* cited by examiner

*Primary Examiner*—George Suchfield
(74) *Attorney, Agent, or Firm*—Trop Pruner & Hu P.C.

(57) ABSTRACT

An apparatus for use in a wellbore having a tubing includes a flow control assembly having at least one orifice and a bore capable of communicating with a bore of the tubing. The flow control assembly includes at least one valve adapted to control fluid flow through the at least one orifice to the bore. The at least one valve is adapted to be actuated between an open position, a closed position, and at least an intermediate position. A sand control assembly is coupled to the flow control assembly and includes a sand screen and a flow path defined inside the sand screen in fluid communication with the at least one orifice.

44 Claims, 5 Drawing Sheets

APPARATUS AND METHOD FOR CONTROLLING FLUID FLOW WITH SAND CONTROL

BACKGROUND OF THE INVENTION

1. Field of Invention

The present invention relates to the field of flow control. More specifically, the invention relates to a device and method for controlling the flow into a conduit through a sand face completion.

2. Related Art

Oil companies are continually improving their recovery systems to produce oil and gas more efficiently and economically from sources that are continually more difficult to exploit, without significantly increasing the cost to the consumer. Two relatively recent developments to increase production are the use of deviated and/or multilateral wells and intelligent completions. In multilateral wells a number of deviated wells are drilled from a main borehole. Intelligent completions generally include downhole monitoring devices and control devices that are remotely actuatable from the surface.

A wellbore may pass through various hydrocarbon bearing zones or may extend through a single zone for a long distance. One manner to increase the production of the well is to perforate the well in a number of different locations, either in the same hydrocarbon bearing zone or in different hydrocarbon bearing zones, to increase the flow of hydrocarbons into the well. One problem associated with producing from a well in this manner relates to the control of the flow of fluids from the well and to the management of the reservoir. For example, in a well producing from a number of separate zones, or lateral branches in a multilateral well, in which one zone has a higher pressure than another zone, the higher pressure zone may produce into the lower pressure zone rather than to the surface. Similarly, in a horizontal well that extends through a single zone, perforations near the "heel" of the well—nearer the surface—may begin to produce water before those perforations near the "toe" of the well. The production of water near the heel reduces the overall production from the well. Likewise, gas coning may reduce the overall production from the well.

A manner of alleviating such problems may be to insert a production tubing into the well, isolate each of the perforations or lateral branches with packers, and control the flow of fluids into or through the tubing. Note that throttling may also be desired in wells having a single perforated production zone. However, typical flow control systems provide for either on or off flow control with no provision for throttling of the flow. To fully control the reservoir and flow as needed to alleviate the above-described problems, the flow must be throttled. A number of devices have been developed or suggested to provide this throttling.

Specifically, the prior devices are typically either wireline retrievable valves, such as those that are set within the side pocket of a mandrel, or tubing retrievable valves that are affixed to the tubing string. An example of a wireline retrievable valve is shown in U.S. patent application Ser. No. 08/912,150, by Ronald E. Pringle entitled "Variable Orifice Gas Lift Valve for High Flow Rates with Detachable Power Source and Method of Using Same" that was filed Aug. 15, 1997, and which is hereby incorporated herein by reference. The variable orifice valve shown in that application is selectively positionable in the offset bore of a side pocket mandrel and provides for variable flow control of fluids into the tubing.

A typical tubing retrievable valve is the standard "sliding sleeve" valve, although other types of valves such as ball valves, flapper valves, and the like may also be used. In a sliding sleeve valve, a sleeve having orifices radially therethrough is positioned in the tubing. The sleeve is movable between an open position, in which the sleeve orifices are aligned with orifices extending through the wall of the tubing to allow flow into the tubing, and a closed position, in which the orifices are not aligned and fluid cannot flow into the tubing.

Other types of downhole valves include the valves shown in U.S. patent application Ser. No. 09/243,401, by David L. Malone, entitled "Valves for Use in Wells" that was filed Feb. 1, 1999, and U.S. patent application Ser. No. 09/325,474, entitled "Apparatus and Method for Controlling Fluid Flow in a Wellbore" by Ronald E. Pringle et al., that was filed Jun. 3, 1999. In general, the valve has valve covers that provide a seal around the periphery of the cover and the orifice through the tubing.

Often, completion equipment includes sand control equipment, which are used to limit the production of sand from a formation. Sand production can damage the well and significantly reduce the production and life of the well. The flow of production fluid may be insufficient to lift the sand from the well resulting in build-up of sand in the well. Sand produced to the surface is a waste product requiring disposal. During production of the sand, the sand acts as an abrasive wearing and eroding downhole components, which may damage downhole tools. Further, production of sand may damage the formation creating voids behind the casing which may result in buckling of or other damage to the casing.

Consequently, various methods and devices for reducing or eliminating sand production have been developed. Gravel packing of the formation is a primary method for controlling the sand production. However, other sand control mechanisms may also be used. Although there are variations, gravel packing essentially involves placing a sand screen around the section of the production string containing the production inlets. This section of the production string is aligned with the perforations. A slurry of gravel and a viscous transport fluid is pumped through the tubing into the formation and the annulus between the sand screen and the casing. The deposited gravel holds the sand in place preventing the sand from flowing to the production tubing while allowing the production fluids to be produced therethrough.

In multi-zone wells or in a well having multiple flow sections, flow control devices (such as the a ones described above) may be used to control fluid flow through orifices formed between the tubing bore and an annulus between the tubing and casing. However, if sand face completion equipment including gravel packing is installed, then the annulus is typically filled, which makes it difficult to position such flow control devices in the proximity of sand control equipment. The formation fluid must first flow generally radially through the sand control device before flowing to the flow control device. One option is to install the flow control device inside a tubing bore in the proximity of the production zone. However, this reduces the available flow area for production flow. Thus, there remains a need for flow control devices that provide incremental choking of the flow and that may be used in sand control completion equipment.

SUMMARY

In general, according to one embodiment, a method of controlling fluid flow in a sand control completion includes providing a flow path from a space defined inside a sand screen to a choked orifice. Further, one of at least an open position, closed position, and an intermediate position of the choked orifice is selected to control fluid flow.

In general, according to another embodiment, an apparatus for use in a wellbore having a tubing includes a flow control assembly having at least one orifice and a bore capable of communicating with a bore of the tubing. The flow control assembly includes at least one valve adapted to control fluid flow through the at least one orifice to the bore. The valve is adapted to be actuated between an open position, a closed position, and at least an intermediate position. A sand control assembly is coupled to the flow control assembly and includes a sand screen and a flow path defined inside the sand screen in fluid communication with the at least one orifice.

Other features and embodiments will become apparent from the following description, the drawings, and the claims.

BRIEF DESCRIPTION OF THE DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments may be possible.

Figure 1:
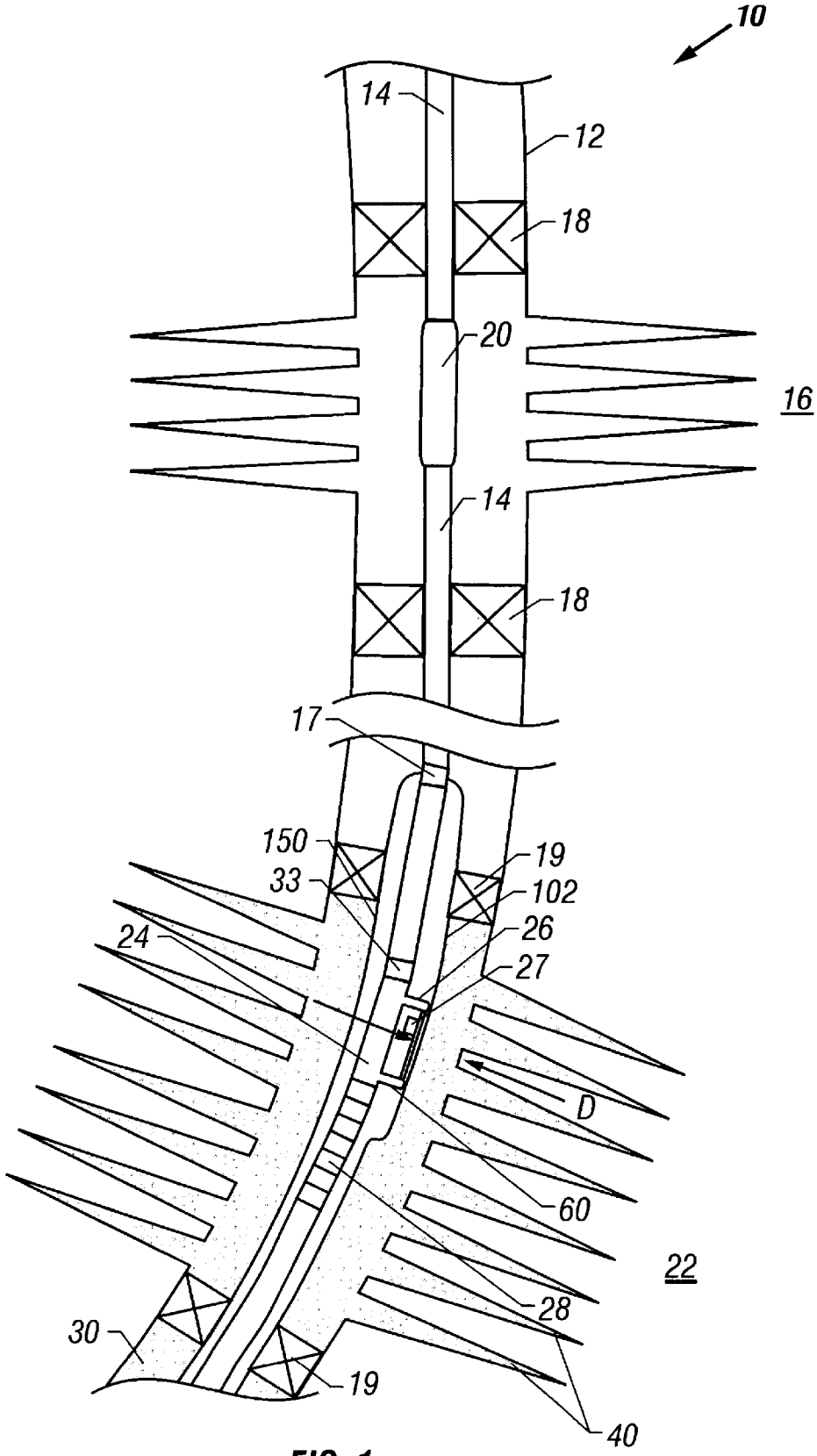
FIG. 1 illustrates an embodiment of a well completion string including completion assemblies proximal a plurality of zones in a wellbore.

Referring to FIG. 1, an example wellbore 10 (e.g., a vertical, deviated, horizontal, or multilateral wellbore) includes multiple production zones (16 and 22 illustrated). A well completion string in accordance with one embodiment in the wellbore 10 includes a production tubing 14 (or other fluid flow conduit) and a completion assembly 20 proximal the first zone 16 and a completion assembly 24 proximal the second zone 22. The completion assemblies 20 and 24 may include packers 18 and 19 (for isolating the zones 16 and 22, respectively, in the wellbore 10), flow control devices (such as valves), monitoring devices (such as sensors to monitor temperature, pressure, flow rates, and other downhole conditions), and control devices (such as actuators for valves, packers, and other devices). The completion assemblies 20 and 24 may be part of an intelligent completion system (ICS), permanent monitoring system (PMS), or other systems that include downhole devices in remote communication with devices located at the well surface or at some other remote location. Thus, for example, sensors in the assemblies 20 and 24 may provide measured data back to the surface or remote equipment. In addition, valves and other devices positioned downhole may be controlled remotely by signals generated by surface or remote equipment.

In accordance with one embodiment, the completion assembly 24 proximal the second zone 22 (hereinafter referred to as "second zone completion assembly") includes a flow control assembly 26 and a sand control assembly 28. The flow control assembly 26 may include a tubular mandrel (such as a side pocket mandrel 60 or other type of mandrel including a flow conduit). The mandrel may also be non-tubular in shape in other embodiments. The side pocket mandrel 60 includes a first bore that is coextensive with the inner bore of the tubing 14. The side pocket mandrel 60 also includes a second bore (a side bore or side pocket) in which a flow control device 27 may be positioned. The flow control device 27 may include a valve actuatable to open, closed, and intermediate choke positions. A choke position of a valve is a position between open and closed. A valve is adapted to choke fluid flow if fluid flow can be varied between open, closed, and at least one choke position.

As used here, a closed position does not necessarily mean that fluid flow is completely blocked through the valve. Generally, for purposes of downhole production, a valve may be considered to be closed if fluid flow through the valve is less than about 6% of the flow rate when the valve is fully open. Alternatively, the mandrel may be a single-bore mandrel having one or more orifices between the bore and the outside of the mandrel. The flow control device 27 may include a sleeve valve or a disc valve such as any of the ones disclosed in U.S. patent application Ser. No. 09/243,401, filed Feb. 1, 1999, by David L. Malone; and U.S. patent application Ser. No. 08/912,150, by Ronald E. Pringle et al., filed Jun. 3, 1999, referenced above and both hereby incorporated by reference. Alternatively, the valve may also be a retrievable valve inserted into the mandrel.

A measurement device 33 may be positioned upstream of the flow control assembly 26. The measurement device 33 may include sensors to measure fluid flow rate, temperature, pressure, and other conditions. Power and signals may be communicated through electrical conductors 150, which may be part of a permanent downhole cable (PDC). In an alternative embodiment, a measurement device may be positioned downstream of the flow control assembly 26 or in any other location in the flow path before the next fluid inlet.

The sand control assembly 28 includes a screen that is surrounded by a gravel pack 30 formed between the inner wall of the casing 12 and the outside of the tubing 14, flow control assembly 26, and sand control assembly 28. The sand control assembly 30 is adapted to reduce sand production from the surrounding formation 22. As used here, the term "screen" includes any permeable structure that may be used in sand control assemblies to permit fluid flow while blocking flow of particulates such as sand. Although reference is made to a sand control assembly for use with a gravel pack in this description, other types of sand control devices may be used in further embodiments to control or exclude production of sand. For example, some other types of sand control assemblies do not use gravel packing.

The sand control assembly 28 and flow control assembly 26 may be used in both open holes and cased wellbores. As shown in FIG. 1, the flow control assembly 26 is positioned in the general proximity of the sand control assembly 28 within the same production zone. A production zone may be defined as a zone proximal a formation provided between two sealing devices, such as packers. Additionally, at the distal end of a main wellbore or a lateral branch of a well, a production zone may be isolated by a sealing device and the bottom of the wellbore or branch. The production zone is adapted to receive fluid from the formation zone to route into a conduit, such a tubing. For sand control, the sand control assembly 28 is positioned in the production zone. For flow control, the flow control assembly 26 is positioned in the production zone.

Figure 2:
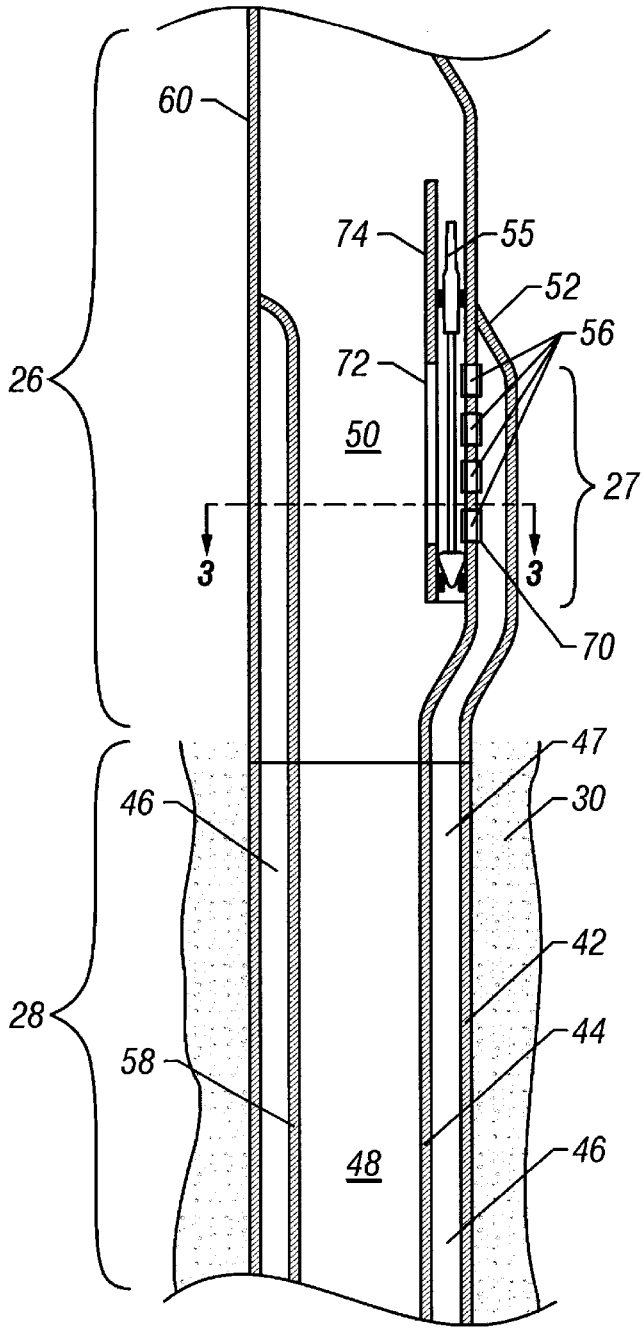
FIGS. 2 and 4 illustrate sand control assemblies and flow control assemblies in accordance with two embodiments in the well completion string of FIG. 1.
Figure 4:
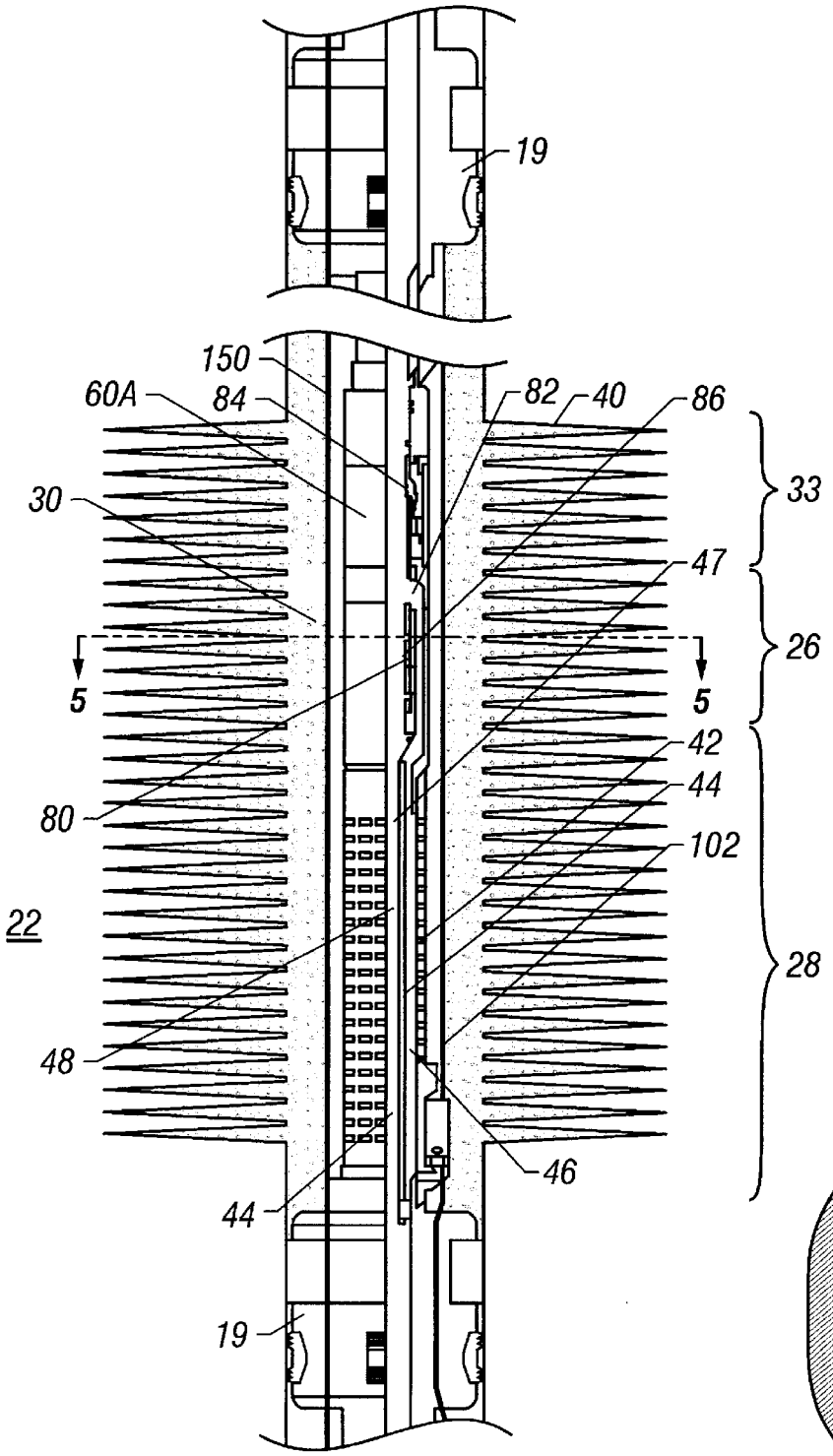

Referring further to FIGS. 2 and 4, second zone completion assemblies 24 according to two embodiments are illustrated in greater detail. The flow control assembly of FIG. 2 includes a disc valve, whereas the flow control assembly of FIG. 4 includes a sleeve valve. In FIG. 2, fluids from the surrounding formation zone flow through perforations, the gravel pack 30, and openings of a screen 42 (the screen 42 being part of the sand control assembly 28). In accordance with some embodiments of the invention, a flow annulus 46 is formed between the inner wall of the screen 42 and an isolation pipe 58 having a bore 48 that is coextensive with the bore of the tubing 14 as well as the main bore 50 of the side pocket mandrel 60 in the flow control assembly 26. In another embodiment, a sleeve (other than the isolation pipe 58) may be provided in the sand screen 42 to define the flow annulus 46. Fluid flowing into the annulus 46 through the screen 42 flows upwardly through a flow path 47 from the annulus 46 to the side pocket mandrel 60. The side pocket mandrel 60 includes the main bore 50 and a side pocket 52 in which a flow control device 27 may be positioned. The flow control device 27 includes disc valves 70, shown in greater detail in FIG. 6.

As shown in FIG. 2, the outer housing of the side pocket mandrel 60 adjacent the side pocket 52 includes one or more orifices 56 through which fluid in the annulus 46 can flow into the side pocket 52. In accordance with some embodiments, the valve 54 can control fluid flow through the one or more orifices 56. The flow control device 27 may be varied between an open position, a closed position, and one or more intermediate choke positions between the open and closed positions. In one embodiment, the disc valves 70 of the flow control device 27 may be formed both on the outside and inside of the orifices 56 to support fluid pressure from the flow annulus 46 and the tubing 14 bore.

Flow entering the side pocket 52 may flow through a side orifice 72 formed in the wall 74 dividing the main bore 50 and side pocket 52 of the side pocket mandrel 60. The side orifice 72 may have a flow area that matches the flow area of the tubing 14. A side pocket tool 55 may optionally be placed into the side pocket 52. The side pocket tool 55 may be any of a number of devices, such as a measurement tool to monitor flow rate, temperature, pressure, and other conditions, an erosion coupon tool to determine if abrasive contaminants are being produced, a shut-off tool to close fluid flow through the orifices 56 and side orifice 72 in case of failure of the flow control device 27, and other types of tools. In some embodiments, the flow control device 27 may be actuated by a downhole actuator, which may be an electrical, hydraulic, or mechanical actuator. In other embodiments, an intervention-type actuator may be lowered into the side pocket 52 to actuate the flow control device 27 between positions.

Figure 3:
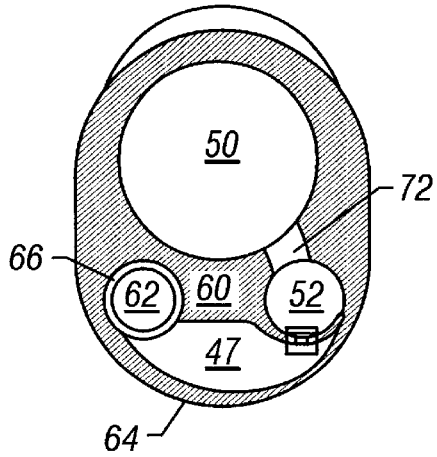
FIGS. 3 and 5 are cross-sectional views of the flow control assemblies of FIGS. 2 and 4, respectively.
Figure 5:
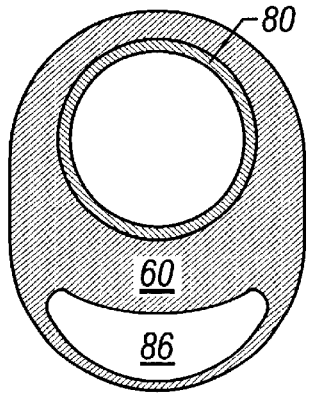

Referring further to FIG. 3, an actuator 62 for the flow control device 27 may be located in a second side pocket 66 that is next to both the side pocket 52 and main bore 50. In alternative embodiments, the chamber containing the actuator 62 may be positioned below or above the side pocket 52. The actuator 62 includes an actuating member (not shown) attached to a corresponding member of the disc valve assembly (FIG. 5).

As shown in FIG. 4, in an alternative embodiment, a sleeve valve 80 is used in the flow control device 27 instead of the disc valve 70 of the FIG. 2 embodiment. The sleeve valve 80 includes a generally concentric sleeve, as illustrated in the cross-sectional view of FIG. 5. Fluid from the formation 22 flows through perforations 40 and the gravel pack 30 and screen 42 to the flow path 47. The flow path 47 leads to the side pocket 86 of the side pocket mandrel 60A. The sleeve valve 80 can be actuated by an actuator 84, which may be an electrical, hydraulic, or mechanical actuator. Each of the actuator 62 (FIG. 3) and actuator 84 (FIG. 4) is capable of providing an open position, a closed position, and at least one intermediate position for the valve 70 or 80, respectively. Some embodiments of indexing mechanisms include those disclosed in U.S. patent application Ser. No. 09/346,265, entitled "Apparatus and Method for Controlling Fluid Flow," by David L. Malone and Ronald E. Pringle, filed Jul. 1, 1999, which is hereby incorporated by reference. Other indexer mechanisms can also be used.

In further embodiments, other types of valves besides disc valves or sleeve valves may be used. For example, retrievable valves may also be employed.

Figure 6:
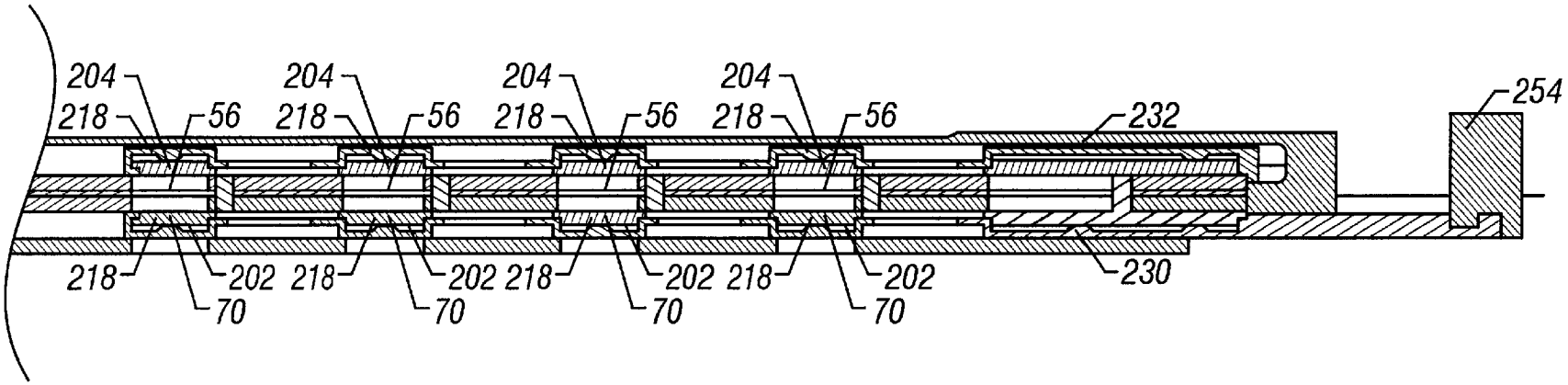
FIG. 6 illustrates the valves of the flow control assembly of FIG. 2 in greater detail.

Referring to FIG. 6, the disc valve assembly in the flow control device 28 in accordance with one embodiment is illustrated in greater detail. Each of the plurality of orifices 56 is associated with a disc valve 70. Each valve 70 has an outer cover 202 and an inner cover 204 on outer and inner sides of the orifice 56. The outer and inner covers 202 and 204 of each valve 70 may be in the form of discs that are in slidable engagement with seats 208 and 210, respectively, which are attached to or formed integrally with the housing of the side pocket mandrel. Each seat 208 and seat 210 surround a corresponding orifice 56. The covers 202 and 204 are slidable over the seats 208 and 210 to provide a variable orifice. Each valve 70 can selectively choke the orifice 56 to set it at an open, closed, and one or more incremental intermediate positions between the open and closed positions.

In the illustrated embodiment, a cover is placed on each side of the orifice 56 to provide pressure integrity in the valve 70 in the presence of pressure from either direction (from outside the mandrel 60 or from inside the mandrel 60). In further embodiments, a cover may be used only on one side of the orifice 56 with some mechanism (such as a pre-load spring) employed to apply a pre-load force against the cover so that the cover can maintain a seal even in the presence of pressure that tends to push the cover away from the seat of the valve 70. Valves according to different embodiments are described in U.S. patent application Ser. No. 09/243,401, referenced above.

To facilitate sliding movement of the covers 202 and 204 over surfaces of the seats 208 and 210 in each valve 70, contact surfaces of the covers and seats may be formed of or coated with a material having a relatively low coefficient of friction. Such a material may include polycrystalline-coated diamond (PCD). Other materials that may be used include vapor deposition diamonds, ceramics, silicon nitride, hardened steel, carbides, cobalt-based alloys or other low friction materials having suitable erosion resistance and hardness. In one embodiment, the covers 202 and 204 and seats 208 and 210 may be formed of a tungsten carbide material that is coated with PCD. By coating the covers 202 and 204 and the seats 208 and 210 with a material having a low coefficient of friction, each valve 70 may be opened or closed with reduced force even in the presence of high internal or external pressure acting on the inner or outer cover 202 or 204.

The covers 202 and 204 are attached to cover carriers 218 and 222, respectively. The carriers 218 for covers 202 are attached in sequence, and the carriers 222 for the covers 204 are similarly arranged in sequence on the other side of the orifices 56. The carriers 218 and 222 are coupled to actuator cover carriers 230 and 232, respectively, which are in turn coupled to a valve actuator member 254. Movement of the valve actuator 254 by the valve actuator 62 causes movement of the carriers 230 and 232 to thereby move the carriers 218 and 222. Movement of the carriers 218 and 222 causes corresponding movement of the covers 202 and 204 to control opening and closing of the orifices 56. Other types of mechanisms for moving the covers 202 and 204 may be employed in further embodiments.

In accordance with some embodiments, the valves 70, which are attached to the side pocket mandrel 60, may remain downhole in the wellbore 10 even though side pocket tools may have been retrieved. This allows flow control to be performed even though a side pocket tool may not be positioned in the side pocket 52. Another advantage of attaching the valves 70 to the side pocket mandrel 60 is that the flow control assembly 26 including the side pocket mandrel 60 may be connected to the sand control assembly 28 and run into the wellbore 10 as part of the same completion string. As a result, two separate runs to install a sand control assembly and a flow control assembly can be avoided. Thus, in accordance with some embodiments, a flow control device that provides open, closed, and choke positions can be integrally assembled with a sand control assembly. Such a flow control device may be permanently located downhole, e.g., as part of an ICS or PMS, and controlled remotely from the surface to control fluid flow in gravel packed or non-gravel packed zones.

Further, by forming an annular path to provide a conduit for fluid from a gravel-packed formation to a flow control device, the main flow path of the completion string for production fluids is left unobstructed by a flow control assembly that may otherwise be placed in the main flow path. The flow control device in accordance to some embodiments includes valves that may be actuatable or selectable between three or more positions (open, closed, and at least one intermediate or choke position).

Figure 7A:
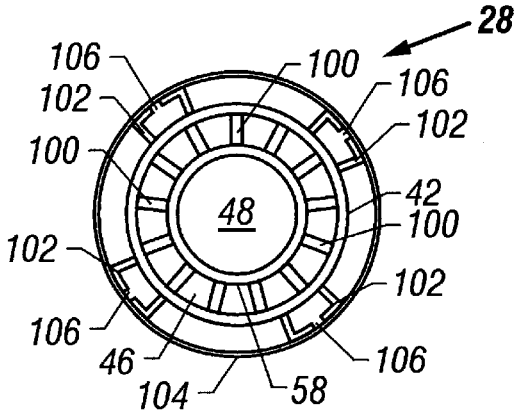
FIGS. 7A and 7B are cross-sectional views of two arrangements of the sand control assembly of FIG. 2 or 3 in accordance with an embodiment.
Figure 7B:
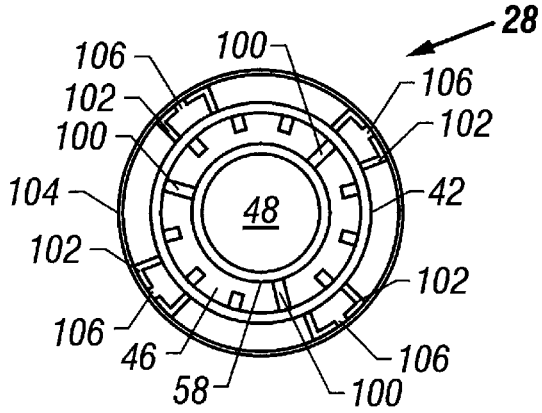

Referring to FIG. 7A, a cross-section of the sand control assembly 28 is illustrated. Support ridges 100 attached to the screen 42 are arranged along the inner circumference of the screen 42. The support ridges 100 are abutted against the outer wall of the pipe 44 to form a space between the pipe 44 and the screen 42 to provide the flow annulus 46 that is part of the flow path 47 through which fluid is routed to the flow control device 27. In accordance with some embodiments, one or more shunt tubes 102 may be attached to the outer wall of the screen 42. Gravel slurry may be pumped down the shunt tubes 102 to fill up the space outside of the flow control assembly 26 and the sand control assembly 28. The shunt tubes 102 are designed to address the problem of poor distribution of gravel, especially with the presence of a protrusion such as the side pocket portion of the side pocket mandrel 26. In addition, a shroud layer 104, which is a thin sheet of metal having perforations formed therein, may be wrapped around the shunt tubes 102 to protect the shunt tubes as the completion string including the sand control assembly 28 is run in or pulled out of the wellbore 10. FIG. 7B shows another embodiment in which the support ridges 100 are spaced further apart.

Referring again to FIG. 1, the annulus between the outsides of the second zone completion assembly 24 and the inner wall of the casing 12 contains a gravel pack 30. To form the gravel pack 30, gravel is pumped in a liquid slurry into the well annulus surrounding the screen 42. The particulate gravel that is carried by the slurry is deposited into the annulus, with the liquid slurry flowing out of the annulus through openings in the screen 42 or into perforations in the surrounding formation. The deposited gravel then collects to form the gravel pack 30. A major issue associated with gravel packing is obtaining proper distribution of the gravel over the entire interval to be completed, in this case the annulus region between the second zone completion assembly 24 and the casing 12. Poor distribution of gravel is often caused by the loss of liquid from the gravel slurry into the more permeable portions of the formation, which causes creation of gravel "bridges" in the annulus before all of the gravel has been placed. These bridges block further flow of the slurry through the annulus. Such a problem is exarcebated when gravel packing around a protrusion such as the protruding housing portion of the side pocket mandrel 60 in the flow control assembly 26. The reduced distance, indicated generally as D, between the outer wall of the side pocket mandrel protruding housing portion and the inner wall of the casing, may encourage formation of gravel bridges. To prevent this, the one or more shunt tubes 102 that act as conduits for the gravel slurry can be made part of the assembly to ensure that the slurry has access to the entire production interval to provide a continuous gravel pack.

Although shown as running on the outside of the side pocket mandrel 60 or 60A in some embodiments, the shunt tubes may be formed integrally in the side pocket mandrel 60 or 60A in other embodiments. The mandrel 60 or 60A may provide conduits in its housing that can be connected to the shunt tubes extending in the annular region.

At periodic intervals, ports 106 may be formed in the shunt tubes 102 to provide communication between the conduits of the shunt tubes 102 and the annulus between the outside of the completion string and inside of the casing 12. The periodic ports 106 are adapted to bypass any bridges that may occur during the gravel pack operation, such as in the reduced region between the outside of the side pocket mandrel 60 and the inside of the casing 12. As a result, a more continuous gravel pack 30 may be provided in the string including the flow control assembly 26 and the sand control assembly 28.

In operation, once the string including the sand control assembly 28 and flow control assembly 26 has been run into the wellbore 10, packers 19 are set. The annular interval defined between the packers 19 in the proximity of the production zone 22 is then gravel packed (in a top-down or bottom-up manner) by pumping a gravel slurry down the production tubing 14. In a cross-over device 17 (FIG. 1) the gravel slurry is flowed into the annular region and into the shunt tubes 102, which are run through the annular interval between the packers 19. Gravel pack 30 is then formed. The cross-over device 17 may include a closing sleeve to shut off communication between the tubing 14 and the annular region after the gravel pack operation is completed.

To produce fluids from the formation zone 22, the flow control device 27 may be set in an open position or a choke position, depending on the desired fluid flow rate and/or interactions with other producing zones. The valve or valves in the flow control device 27 may be actuated by a downhole actuator in response to a command sent from the well surface or a module in an ICS. The command may include an electrical signal, low-level pressure pulse command, a predetermined hydraulic pressure, or any other activation signal. Opening the flow control device 27 allows formation 22 fluid to flow through perforations 40, the gravel pack 30, and openings in the screen 42 into the flow annulus 46 and flow path 47. The fluid continues up the flow path 47 to the flow control device 27, through which the fluid flows into the main bore 50 of the flow control device 27 and up the tubing 14.

Figure 8:
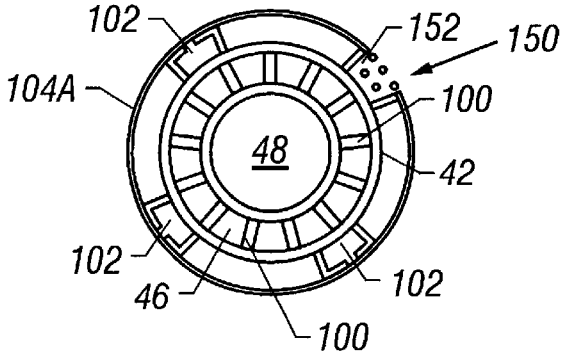
FIG. 8 is a cross-sectional view of the sand control assembly of FIG. 2 or 3 in accordance with another embodiment.

If electrical modules (such as sensors or control devices) are positioned in the sand control assembly 28 or below the sand control assembly 28, then it may be desirable to route electrical conductors to the electrical modules. To do so, PDC conductors may be extended to the sand control assembly 28. Referring to FIG. 8, this may be accomplished in one embodiment by providing a control line routing channel 152 through which control lines 150 (including electrical conductors) may be passed through. The control lines 150 may also include hydraulic control lines in addition to electrical control lines. The control line routing channel 152 may be provided in place of a shunt tube 102 for gravel slurry. In one embodiment, an outer shroud 104A may be cut off at the borders of the channel 152 so that the channel 152 can remain un-covered.

While the invention has been disclosed with respect to a limited number of embodiments, those skilled in the art will appreciate numerous modifications and variations therefrom. It is intended that the appended claims cover all such modifications and variations as fall within the true spirit and scope of the invention. It is the express intention of the applicant not to invoke 35 U.S.C. § 112, paragraph 6 for any limitations of any of the claims herein, except for those in which the claim expressly uses the word "means" together with an associated function.

I claim:

1. An apparatus for use in a wellbore having a tubing, comprising:

a flow control assembly having a side pocket mandrel having at least one orifice, a main bore capable of communicating with a bore of the tubing, and an offset bore, the flow control assembly including at least one valve adapted to control fluid flow through the at least one orifice to the offset bore, the valve adapted to be actuated between an open position, a closed position, and at least an intermediate position; and a sand control assembly coupled to the flow control assembly and including a sand screen and a flow path defined inside the sand screen in fluid communication with the at least one orifice.

2. The apparatus of claim 1, wherein the flow control assembly further comprises a valve actuator operatively attached to the at least one valve.

3. The apparatus of claim 2, wherein the flow control assembly includes a chamber in which the valve actuator is situated.

4. The apparatus of claim 1, wherein the side pocket mandrel further includes a second side pocket, the flow control assembly further including a valve actuator placed in the second side pocket for actuating the at least one valve.

5. An apparatus for use in a wellbore having a tubing, comprising:

a flow control assembly having at least one orifice and a bore capable of communicating with a bore of the tubing, the flow control assembly including at least one valve adapted to control fluid flow through the at least one orifice to the bore, the valve adapted to be actuated between an open position, a closed position, and at least an intermediate position; and a sand control assembly coupled to the flow control assembly and including a sand screen and a flow path defined inside the sand screen in fluid communication with the at least one orifice, wherein the at least one valve includes at least a disc valve to control flow through the at least one orifice.

6. The apparatus of claim 5, wherein the sand control assembly further includes a pipe and an annulus formed between the sand screen and the pipe, the annulus being part of the flow path.

7. The apparatus of claim 6, wherein the flow path extends from the annulus to the at least one orifice.

8. The apparatus of claim 6, wherein the pipe includes a bore that is in communication with the bore of the flow control assembly.

9. The apparatus of claim 5, wherein the flow control assembly includes a side pocket mandrel having the bore and a side pocket in which at least a part of the at least one valve is located.

10. The apparatus of claim 5, wherein the at least one disc valve includes a cover slidably engaged to a seat defined around the orifice.

11. The apparatus of claim 10, wherein each of the cover and seat is formed partly of a material having a low coefficient of friction.

12. The apparatus of claim 11, wherein the material is selected from a group consisting of polycrystalline-coated diamond, vapor deposition diamond, ceramic, silicon nitride, hardened steel, carbide, and cobalt-based alloy.

13. The apparatus of claim 1, wherein the at least one valve includes a sleeve valve.

14. The apparatus of claim 5, wherein the flow control assembly and sand control assembly are part of a completion string capable of being run into the wellbore together.

15. The apparatus of claim 1, further comprising at least a shunt conduit extending outside the flow control assembly and the sand control assembly, the at least one shunt conduit adapted to carry a gravel slurry.

16. The apparatus of claim 15, wherein the at least one shunt conduit is attached to the outside of the sand screen.

17. A completion assembly for use in a production zone of a well, the well including a flow conduit, the completion assembly comprising:

a sand control assembly for positioning in the production zone; and a flow control assembly for positioning in the production zone and for fluid communication with the flow conduit, the flow control assembly including a side pocket mandrel having a main bore, a side pocket, and at least one orifice leading to the side pocket mandrel from outside the side pocket mandrel, the flow control assembly further having at least one valve adapted to control fluid flow through the at least one orifice to the flow conduit, the at least one valve adapted to be actuated between an open position, a closed position, and at least an intermediate position, the sand control assembly including a sand screen and a flow channel defined inside the sand screen, the flow channel being in fluid communication with the at least one orifice.

18. The completion assembly of claim 17, further comprising sealing devices adapted to isolate the production zone proximal a formation in the well.

19. The completion assembly of claim 18, wherein the sealing devices include packers.

20. A completion assembly for use in a wellbore, comprising:

a tubing extending into the wellbore;

a mandrel defining a main bore at least partially therethrough, the mandrel attached to the tubing, and the main bore in fluid communication with the tubing, the mandrel further defining a second bore having a longitudinal axis offset from that of the main bore, the mandrel defining at least one choked orifice in communication with the second bore, the choked orifice adjustable between at least an open position and a partially open position;

a sand control assembly having an interior in fluid communication with the at least one choked orifice.

21. The completion assembly of claim 20, further comprising a flow control device cooperating with the orifice to control fluid flow through the orifice.

22. The completion assembly of claim 21, wherein the flow control device includes one or more valves actuatable to an open position, a closed position, and at least a choke position.

23. A completion assembly for use in a wellbore, comprising:

a tubing extending into the wellbore;

a mandrel defining a bore at least partially therethrough, the mandrel attached to the tubing, and the bore in fluid communication with the tubing, the mandrel defining at least one choked orifice in communication with the bore, the choked orifice adjustable between at least an open position and a partially open position;

a sand control assembly having an interior in fluid communication with the at least one choked orifice; and a flow control device cooperating with the orifice to control fluid flow through the orifice, wherein the flow control device includes one or more valves actuatable to an open position, a closed position, and at least a choke position, and wherein the one or more valves include disc valves.

24. The completion assembly of claim 20, further comprising one or more shunt conduits adapted to carry gravel slurry.

25. The completion assembly of claim 24, wherein the sand control assembly includes a sand screen, and wherein the one or more shunt conduits are arranged outside the sand screen.

26. The completion assembly of claim 20, further comprising at least a conduit for carrying one or more control lines, wherein the sand control assembly comprises a sand screen, the conduit being attached to outside the sand screen.

27. A method of controlling fluid flow in a sand control completion in a well, the method comprising:

providing a flow path from a space defined inside a sand screen to at least a choked orifice;

providing the choked orifice in a side pocket mandrel having a main bore and an offset bore;

selecting one of at least an open position, closed position, and an intermediate position of the at least one choked orifice to control fluid flow; and communicating fluid between the flow path and the offset bore through the choked orifice.

28. The method of claim 27, wherein providing the flow path includes providing at least an annular space between the sand screen and a pipe.

29. The method of claim 27, further comprising arranging one or more valves to control flow through the choked orifice.

30. The method of claim 29, wherein arranging the one or more valves includes placing the one or more valves in the offset bore of the side pocket mandrel.

31. The method of claim 27, further comprising:

providing at least a valve including the at least one choked orifice; and positioning the at least one valve and the sand screen inside a production zone proximal a formation in the well.

32. The apparatus of claim 1, wherein the side pocket mandrel has at least another orifice, and wherein the at least one valve comprises a plurality of covers to control flow through corresponding orifices.

33. The apparatus of claim 1, wherein the sand control assembly further comprises a pipe and an annulus formed between the sand screen and the pipe, the annulus being part of the flow path.

34. The apparatus of claim 33, wherein the flow path extends from the annulus to the at least one orifice.

35. The apparatus of claim 1, wherein at least a part of the at least one valve is located in the offset bore of the side pocket mandrel.

36. The apparatus of claim 35, wherein the side pocket mandrel has a wall separating the offset bore and the main bore, and at least one side port defined in the wall to enable communication between the offset bore and the main bore.

37. The apparatus of claim 36, wherein the at least one side port has a flow area that matches a flow area of the tubing.

38. The apparatus of claim 1, wherein a longitudinal axis of the offset bore is offset from the longitudinal axis of the main bore.

39. The completion assembly of claim 17, wherein the at least one valve comprises a disc valve.

40. The completion assembly of claim 17, wherein the side pocket comprises an offset bore having a longitudinal axis offset from a longitudinal axis of the main bore of the side pocket mandrel.

41. The completion assembly of claim 20, wherein the mandrel comprises a side pocket mandrel.

42. The completion assembly of claim 22, wherein the one or more valves comprise one or more disc valves.

43. The method of claim 29, wherein arranging the one or more valves comprises arranging one or more disc valves.

44. The method of claim 27, wherein providing the choked orifice in the side pocket mandrel comprises providing the offset bore having a longitudinal axis that is offset from a longitudinal axis of the main bore.

* * * * *